US005971644A

United States Patent [19]

Kageyama et al.

[11] Patent Number: 5,971,644

[45] Date of Patent: Oct. 26, 1999

[54] SIDE KNOCK-TYPE WRITING INSTRUMENT

[75] Inventors: Hidehei Kageyama; Tomiji Ueki; Yoshihide Mitsuya, all of Kawagoe, Japan

[73] Assignee: Kotobuki & Co., Ltd., Kyoto, Japan

[21] Appl. No.: 09/115,653

[22] Filed: Jul. 15, 1998

[51] Int. Cl.[6] ..... B43K 5/16

[52] U.S. Cl. ..... 401/99; 401/65; 401/54; 401/6

[58] Field of Search ..... 401/99, 65, 63, 401/54, 52, 55, 6, 7, 92, 88; 15/437, 443, 444

[56] References Cited

U.S. PATENT DOCUMENTS

| | | | |
|---|---|---|---|
| H1050 | 5/1992 | Petrillo | 401/6 |
| 4,601,598 | 7/1986 | Schwartz et al. | 401/6 |

FOREIGN PATENT DOCUMENTS

| | | |
|---|---|---|
| 004036817 | 5/1992 | Germany . |
| 403264397 | 11/1991 | Japan . |

*Primary Examiner*—David J. Walczak
*Assistant Examiner*—Huyen Le
*Attorney, Agent, or Firm*—McGinn & Gibb, P.C.

[57] ABSTRACT

A writing instrument includes a barrel having a substantially cylindrical body, the cylindrical body having a finger gripping area and an outer circumferential recess portion provided around the finger gripping area, a writing medium advancing mechanism axially movably disposed within the barrel, an actuating member provided at the outer circumferential recess portion for actuating the writing medium advancing means, the actuating member being engaged with the writing medium advancing mechanism, and a finger gripping member provided around the circumferential recess portion of the cylindrical body, the finger gripping member having an opening, the actuating member being exposed externally through the opening of the finger gripping member.

15 Claims, 4 Drawing Sheets

SIDE KNOCK-TYPE WRITING INSTRUMENT

BACKGROUND OF THE INVENTION

1. Field of the Invention

This invention relates to a side knock-type writing instrument, e.g., a mechanical pencil or a ball-point pen, and more particularly to a side knock-type writing instrument provided with a finger gripping member for ensuring a user's comfortable gripping of a barrel of the writing instrument so as not to cause a user to be fatigued in use of the writing instrument.

2. Description of the Prior Art

This kind of side knock-type ball-point pen is disclosed in Japanese Utility Model Publication No. 19835/1995. Referring now to FIG. 1, the conventional ball-point pen comprises a barrel 1, a refill 3 axially movably disposed within the barrel 1, a first spring member 5 for urging the refill 3 into a retracted position, an actuating member 7 for- causing the refill 3 to be moved an extended position, a rotary cam mechanism 9 disposed within the barrel 1 and placed behind the refill 3, and a second spring member 11 having a resilience weaker than that of the first spring member 5. The barrel 1 has a head section 13 threadedly attached to a front end thereof, and an axially extending hole 15 formed in a potion of a wall of the barrel 1 which is adjacent the front end of the barrel 1. The refill 3 is provided with a spring clip 17. The first spring member 5 is disposed between the head section 13 of the barrel 1 and the spring clip 17. The actuating member 7 is axially movably received in the axially extending hole 15 and engaged with the refill 3. The rotary cam mechanism 9 includes a cam body 19 disposed within the barrel 1 so as to surround a rear end portion of the refill 3, a rotary element 21 mounted on the rear end portion of the refill 3 and disposed within the can body 19, and a cam bar 23 received in the cam body 19. The cam bar 23 has a first end portion and a second end portion. The first end portion of the cam bar 23 is engaged with the rotary element 21. The second end portion of the cam bar 23 extends in a rearward direction through a rear end of the cam body 19. The second spring member 11 is disposed between a stopper member 25 fitted in a rear end of the barrel 1 and the cam bar 23, whereby the cam bar 23 is always urged forward.

Indeed the prior art referred to in the above is effective in selectively retracting and extending a writing tip of the refill 3 by causing the actuating member 7 to be axially moved along the axially extending hole 15 of the barrel 1.

However, the conventional writing instrument is not provided with any finger gripping member, so that it will cause a user to be fatigued during prolonged writing by the writing instrument and it will be liable to slip off the user's fingers during the writing.

There is not yet proposed a side knock-type writing instrument which is provided with a finger gripping member. When a side knock-type writing instrument is provided with any finger gripping member, it is necessary to cause the finger gripping member to be attached to a barrel of the writing instrument such that movement of the finger gripping member relative to the barrel is prevented.

SUMMARY OF THE INVENTION

The present invention has been made with a view to overcoming the foregoing problems of the prior art writing instrument.

It is therefore an object of this invention to provide a side knocktype writing instrument with finger gripping means, which can ensure a user's comfortable gripping of a barrel of the writing instrument so as not to cause a user to be fatigued in use of the writing instrument.

It is another object of this invention to provide a side knock-type writing instrument with finger gripping means, in which movement of the finger gripping means relative to a barrel of the writing instrument is prevented.

In accordance with the present invention, there is provided a side knock-type writing instrument. The writing instrument comprises a barrel having a substantially cylindrical body, the cylindrical body having a finger gripping area and an outer circumferential recess portion provided around the finger gripping arca, writing medium advancing means axially movably disposed within the barrel, actuating means provided at the outer circumferential recess portion for actuating the writing medium advancing means, the actuating means being engaged with the writing medium advancing means, and finger gripping means provided around the circumferential recess portion of the cylindrical body, the finger gripping means having a first opening, the actuating means being exposed externally through the first opening of the finger gripping mcans.

The cylindrical body of the barrel may comprise means for preventing movement of the finger gripping means relative to the barrel The cylindrical body of the barrel may have a second opening formed in the outer circumferential recess portion thereof, in which second opening the actuating means is received. The means for preventing movement of the finger gripping means relative to the barrel comprises a frame portion which rises up from a bottom of the recess portion and surrounds the second opening.

The writing instrument may comprise cooperating means on the barrel and finger gripping means for preventing movement of the finger gripping means relative to the barrel. The finger gripping scans has first and second ends. The cooperating means comprises first and second projections axially projecting into the recess portion of the barrel from opposite walls of the recess portion, and first and second grooves formed in the first and second ends of the finger gripping means and axially extending. The finger gripping means is mounted within the recess portion of the barrel with the first and second grooves thereof receiving the first and second projections therein.

BRIEF DESCRIPTION OF THE DRAWINGS

Other objects and may of the attendant advantages of the present invention will be readily appreciated as the same becomes better understood by reference to the following detailed description when considered in connection with the accompanying drawings, in which like reference numerals designate the same parts throughout the Figures and wherein.

DETAILED DESCRIPTION OF THE PREFERRED EMBODIMENTS

A side knock-type writing instrument according to the present invention will be discussed hereinafter with reference to the accompanying drawings. The writing instrument generally includes a barrel having a substantially cylindrical body, the cylindrical body having a finger gripping area which is to be gripped by user's fingers in use, finger gripping means mounted around the finger gripping area, writing lead advancing means disposed within the barrel for advancing a piece of writing lead, and actuating means for actuating the writing lead; advancing means.

Figure 1:
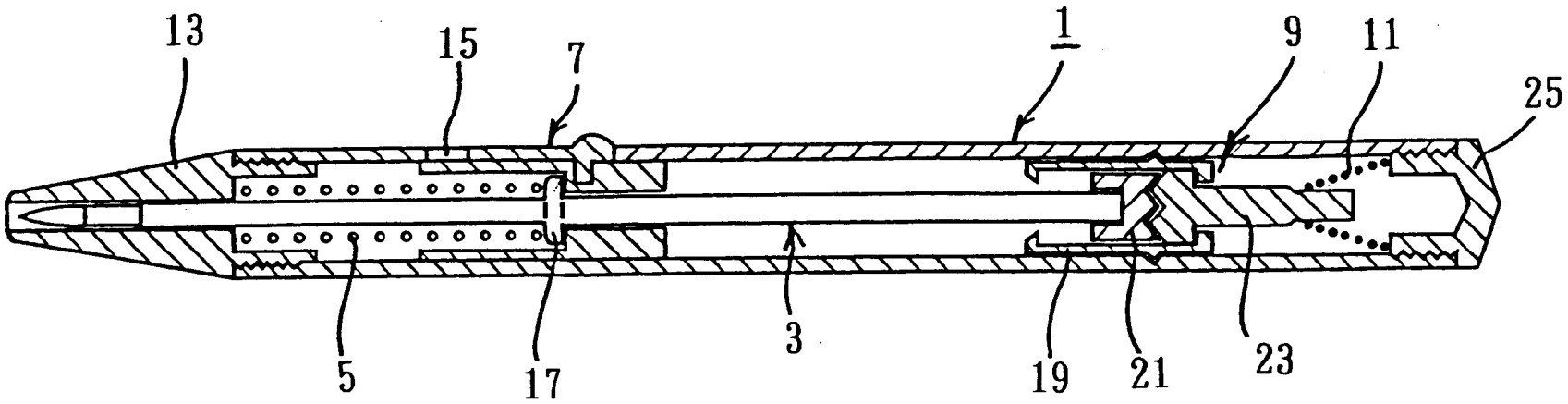
FIG. 1 PRIOR ART
FIG. 1 is a schematic longitudinal sectional view of a conventional ball-point pen.
Figure 2:
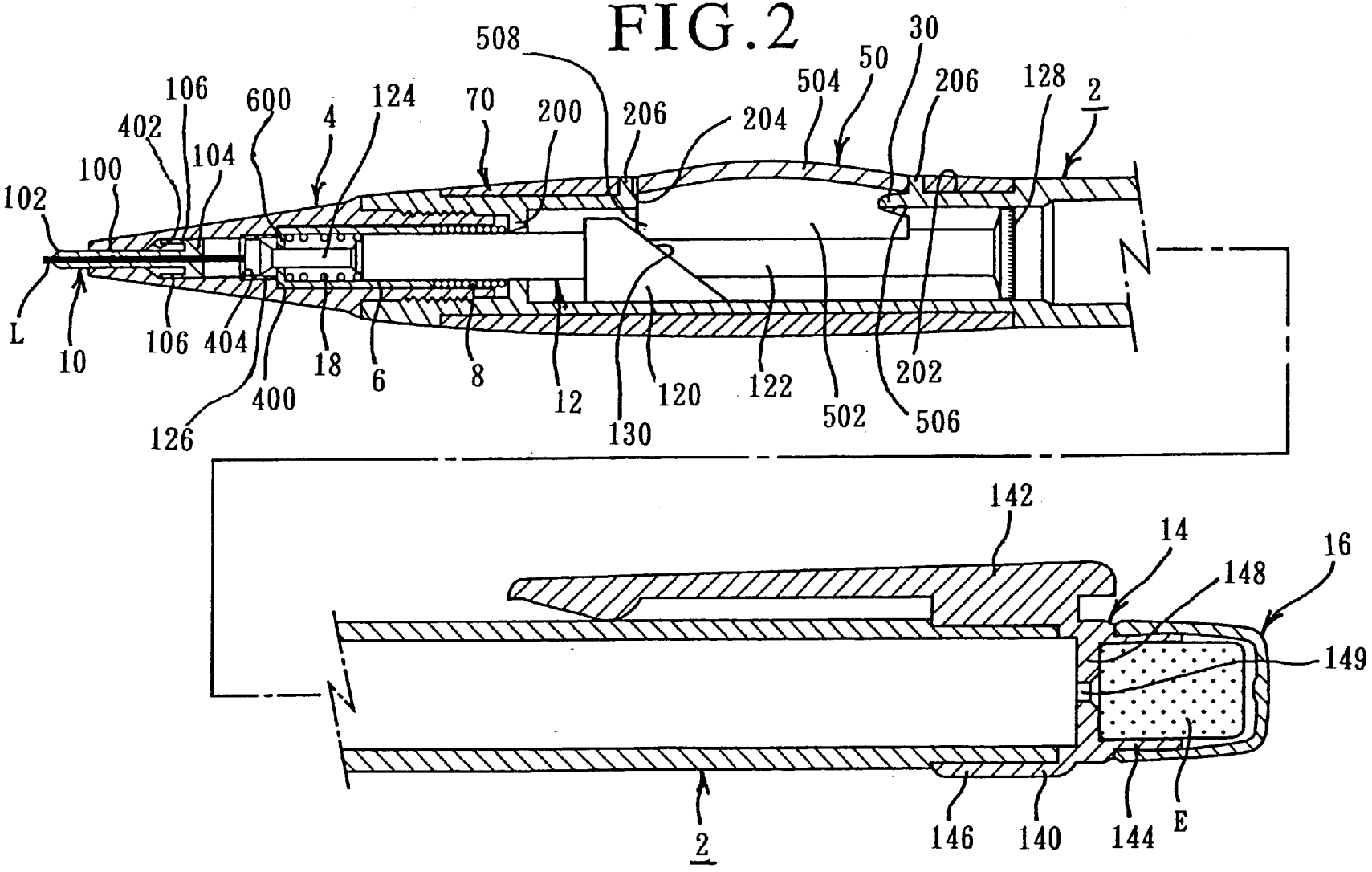
FIG. 2 is a schematic longitudinal sectional view of a mechanical pencil according to an embodiment of the present invention.
Figure 3:
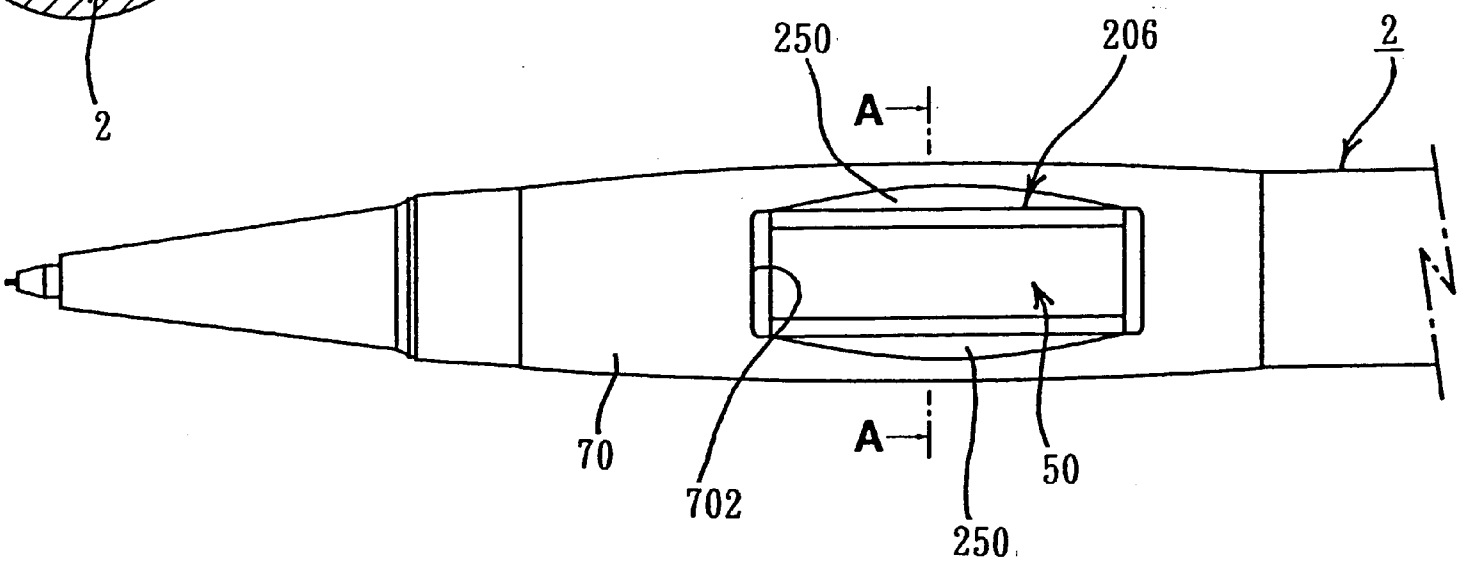
FIG. 3 is a schematic fragmentary view of the mechanical pencil.
Figure 4:
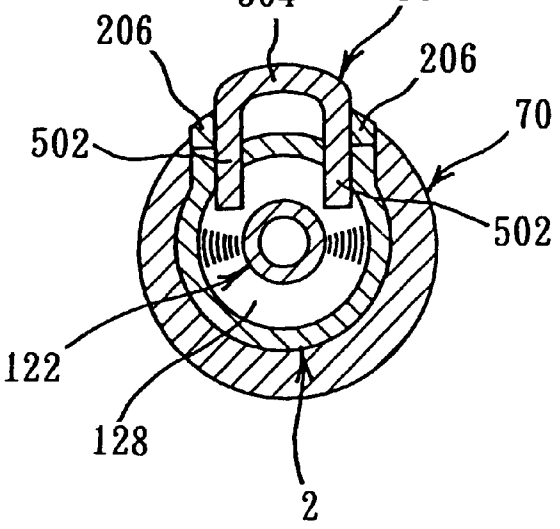
FIG. 4 is a schematic enlarged cross-sectional view of the mechanical pencil, taken an a plane indicated in FIG. 3 by a line A—A.

Referring to FIGS. 2–4, there is illustrated a side knock-type mechanical pencil according to an embodiment of the present invention. A barrel, 2 has a ring-like projection 200 projecting inwardly from an inner surface of a region adjacent a forward end of the barrel 2, an outer circumferential recess portion 202 provided around a finger gripping area which is to be gripped by user's fingers, a substantially rectangular opening 204 formed in a portion of a bottom of the recess portion 202, a substantially rectangular frame portion 206 rising up from the bottom of the recess portion 202 and surrounding the opening 204, and a head section 4 threadedly attached to the forward end of the barrel 2.

The head section 4 has first, second and third inner circumferential step portions 400, 402, 404 provided around an inner surface thereof and axially spaced apart from one another. The head section 4 is formed to have a substantially cone-shape in outline, Disposed between the first inner circumferential step portion 400 of the head section 4 and the ring-like projection 200 of the barrel 2 is a sleeve G. The sleeve 6 is provided with an inwardly protecting flange portion 600 at a front end thereof. Disposed between a rear end of the sleeve 6 and the ring-like portion 200 of the barrel 2 is a first coil spring 8 which always urges the sleeve 5 forwardly to cause the sleeve 6 to be pressed against the first step portion 400 of the head section 4. The first coil spring 8 serves as means to absorb an excessive writing force which may be applied to a writing lead during writing by using the mechanical pencil.

A slider 10 for holding, by virtue of frictional resistance, a writing lead L which is supplied to the slider 10 from writing lead advancing means 12 is axially slidably fitted in a tip end of the head section 4. The slider 10 comprises a substantially cylindrical slider body 100 having first and second ends 102, 104, and a plurality of radially deformable resilient pieces 106 extending from the second end 104 to the first end 102. The radially deformable resilient pieces 106 are spaced apart from one another around an outer periphery of the slider body 100. When the writing lead L is advanced by the writing lead advancing means 12 and arrives at the slider 10, the writing lead causes the slider 19 to be slid forwardly, while entering a longitudinal bore of the cylindrical slider body 100. The forward movement of the slider 10 is limited by engagement between the second step portion 402 of the head section 4 and free ends of the resilient pieces 106 as shown in FIG. 2.

A holder 14 for holding a rubber eraser E is detachably attached to a rear end portion of the barrel 2. The rubber eraser holder 14 comprises a tubular body 140 and a clip portion 142 formed integrally with the tubular body 140 for clipping the mechanical pencil to a shirt or jacket or the like. The tubular body 140 has a first tubular section 144 and a second tubular section 146. The first tubular section 144 and the second tubular section 146 are partitioned by a plate 148. The rubber eraser E is received within the first tubular section 144 of the rubber eraser holder 14 and put on the plate 148. The rubber eraser holder 14 is detachably attached to the rear end portion of the barrel 2 with the second tubular section 146 being mounted on the rear end portion of the barrel 2 and with the plate 148 closing the rear end portion of the barrel 2. The plate 148 is formed with a through-hole 149 for allowing a writing lead to be put into the barrel 2 therethrough. More particularly, supplying of a writing lead into the barrel 2 can be performed by removing the rubber eraser E from the first tubular section 144 of the holder 14 and putting the writing lead into the barrel 2 through the through-hole 149. A cap 16 for covering the rubber eraser E is removably mounted on the first tubular section 144 of the holder 14.

The writing lead advancing means 12 is axially movably disposed within the barrel 2 and comprises a block-like portion 120, a writing lead passageway 122 formed integrally with the block-like portion 120 and extending through the block-like portion 120, a chuck member 124 connected to a front end of the writing lead passageway 122 for releasably gripping a piece of writing lead, and a chuck ring 126 loosely mounted on a head of the chuck member 124 for tightening the chuck member 124. The writing lead passageway 122 comprises a substantially cylindrical body and is inserted at the front end portion thereof in the sleeve 6. The head of the chuck member 124 connected to the front end of the writing lead passageway 122 is projected outwardly from the sleeve 6. Disposed between the inwardly projecting flange portion 600 of the sleeve 6 and the front end of the writing lead passageway 122 is a second coil spring 18 which always urges the writing lead advancing means 12 backwardly. The writing lead passageway 122 is provided with a large outer diameter section 128 at a rear end thereof. The large outer diameter section 128 is formed to have a substantially funnel-shape in order that the writing lead passageway 122 can easily receive a lead of writing lead which is put in the barrel 2. The block-like portion 120 has a slanted surface 130 which is inclined relative Lo a longitudinal axis of the writing lead passageway 122 and slopes in a rearward direction.

Actuating means 50 for actuating the writing lead advancing means 12 comprises a substantially inverted U-shaped body in cross-section as shown in FIG. 4. The inverted U-shaped body of the actuating means 50 comprises two spaced apart plate sections 502 and an intermediate plate section 504 interconnecting the spaced apart plate sections 502. Each of the spaced apart plate sections 502 has a first end and a second end, and is formed with a notch 506 (FIG. 2) in the first end thereof. The actuating leans 50 is received in the opening 204 of the barrel 2 and pivotally supported to the barrel 2. More particularly, a projecting piece 30 projects into the opening 204 of the barrel 2 from a rear end portion of the opening 204, and the actuating means 50 is received in the opening 204 of the barrel 2 with notches 506 of the spaced apart plate sections 502 receiving the projecting piece 30 of the opening 204 of the barrel 2. whereby the actuating means 50 can pivot about the projecting piece 30. Second ends 508 of the spaced apart plate sections 502 of the actuating means 50 are engaged at lower areas thereof with the slanted surface 130 of the block-like portion 120 of the writing lead advancing means 12 as shown in FIG. 2. Incidentally, in order to facilitate pressing or knocking the actuating means 50, opposite side portions 250 of the opening 204 of the barrel 2 is gouged as shown in FIG. 3, and curved radially.

A finger gripping member 70 of a substantially cylindrical shave in outline is mounted around the circumferential recess portion 202 of the barrel 2. The finger gripping member 70 is formed of an elastic material, such as a rubber or flexible plastic, and has an opening 702 formed in an area thereof which positionally corresponding to the frame portion 206 of the barrel 2. The finger gripping member 70 is mounted around the circumferential recess portion 202 of the barrel 2 with an edge of the opening 702 surrounding the frame portion 206 of the barrel 2. Thus, movement of the finger gripping member 70 relative to the barrel 2 can be prevented by the frame portion 206 of the barrel 2.

The operation of the side knock-type mechanical pencil according to the first embodiment of the present invention will be discussed hereinafter. In state where a piece of writing lead which is received in the writing lead passageway 122 of the writing lead advancing means 12 is chucked at a tip end thereof by the chuck member 124, when the actuating means 50 is pressed or knocked inwardly relative to the barrel 2 for delivery of the writing lead, the actuating means 50 is pivoted about the projecting piece 30 of the barrel 2 and the lower areas of the second ends 508 of the spaced apart plate sections 502 of the actuating means 50 slide along the slanted surface 130 of the block-like portion 120, whereby the writing lead advancing means 12 is moved forward against the biasing force of the second coil spring 18. In the course of this forward movement, the chuck ring 126, which is loosely mounted on the head of the chuck member 124, comes into abutment with the third inner circumferential step portion 404 of the head section 4 and the chuck member 124 extends forward from the chuck ring 126. When the chuck member 124 extends forward from the chuck ring 126, it causes the piece of writing lead to he moved forward, while loosening its grip on the piece of writing lead. When the actuating means 50 is repeatedly knocked, the piece of writing lead is further advanced by the chuck member 124 and causes the slider 10 to be slid forward, while entering the cylindrical slider body 100. Thus, by repeating this knocking operation, the piece of writing lead is pushed out to permit writing.

Upon release of the knock, the writing lead advancing means 12 is returned to its original position by the second coil spring 18. Furthermore, as the writing lead advancing means 12 returns to its original position, the chuck member 124 also retracts into the chuck ring 126. As it does so, it regains its grip on the piece of writing lead. In this condition, the mechanical pencil can be used for writing. After writing, by pushing the writing lead tip lightly against the paper surface or pushing it lightly with a user's finger tip and simultaneously pressing the actuating means 50, the chuck member 124 is released and the writing load and the slider 10 are received back into the barrel 2.

Figure 5:
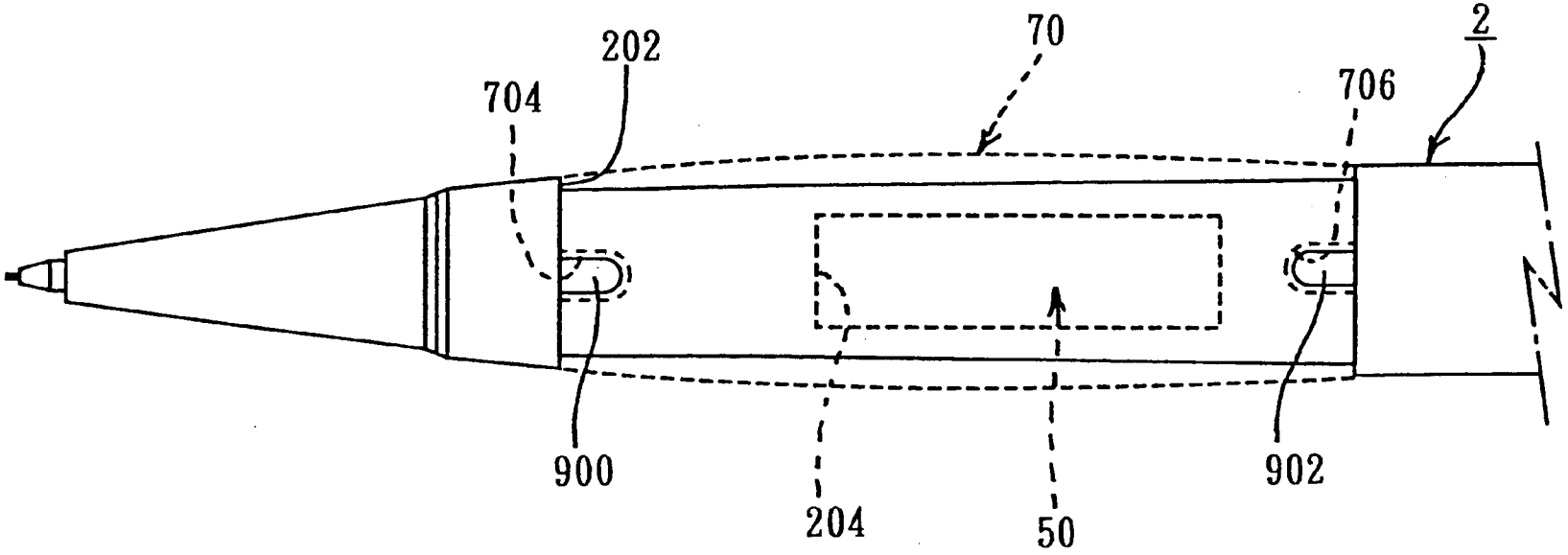
FIG. 5 is a schematic fragmentary view of a modification of the embodiment of FIGS. 2–4.

Referring to FIGS. 5, there is illustrated a modification of the mechanical pencil shown in FIGS. 2–4. This modification is substantially similar to the embodiment of FIGS. 2–4 except that cooperating means on the barrel 2 and finger gripping means 70 for preventing movement of the finger gripping member 70 relative to the barrel 2 is employed in lieu of the frame portion 206 shown in FIGS. 2–4. In the illustrated example, components which are substantially similar to those shown in FIGS. 2–4 are designated with like reference numerals and the description; of them will not be repeated.

The cooperating means comprises first and second projections 900, 902 axially projecting into the recess portion 202 of the barrel 2 from opposite walls of the recess portion 202, and first and second grooves 704, 706 formed in first and second ends of the finger gripping member 70 and axially extending. The finger gripping member 70 is mounted within the recess portion 202 of the barrel 2 with the first and second grooves 704, 706 thereof receiving the first and second projections 900, 9U2 6i therein. Thus, movement of the finger gripping member 70 relative to the barrel 2 can be effectively prevented. In the illustrated example, the cooperating means has one projection 900, one projection 902, one groove 704 and one groove 706. However, the cooperating means 80 my comprise a plurality of the first and second projections 900, 902 which are spaced apart from one another around the circumferential recess portion 202 of the barrel 2, and a plurality of the first and second grooves 704, 706 which are spaced apart from one another around an inner circumferential surface of the finger gripping member 70.

The operation of the side-knock mechanical pencil shown in FIG. 5 is performed in the same manner as that of the side-knock mechanical pencil shown in FIGS. 2–4 is done. Therefore, the description of the operation will nut be repeated.

While the mechanical pencil according to the present invention is referred to in the above, this invention may be applied to a ball-point pen or the like.

The terms and expressions which have been employed are used as terns of description and not of limitation, and there is no intention in the use of such terns and expressions of excluding any equivalents of the features shown and described, or portions thereof, but it is recognized that various modifications are possible within the scope of the invention

What is claimed:

1. A writing instrument comprising:

a barrel having a substantially cylindrical body, said cylindrical body having a finger gripping area, an outer circumferential recess portion provided around said finger gripping area, and a first opening formed in said outer circumferential recess portion;

writing medium advancing means axially movably disposed within said barrel;

actuating means received in said first opening of said cylindrical body for actuating said writing medium advancing means, said actuating means being engaged with said writing medium advancing means;

finger gripping means provided around said circumferential recess portion of said cylindrical body, said finger gripping means having a second opening, said actuating means being exposed externally through said second opening of said finger gripping means; and means for preventing movement of said finger gripping means relative to said barrel, comprising a frame portion which rises up from a bottom of said recess portion and surrounds said first opening of said cylindrical body, said finger gripping means being provided around said circumferential recess portion of said cylindrical body with an edge of said second opening surrounding said frame portion.

2. A writing instrument as claimed in claim 1, wherein said finger gripping means is formed of an elastic material.

3. A writing instrument as claimed in claim 1, wherein said finger gripping means comprises an elastic material.

4. A writing instrument comprising:

a barrel having a cylindrical body, said cylindrical body having a finger gripping area and an outer circumferential recess portion provided around said finger gripping area;

writing medium advancing means axially movably disposed within said barrel;

actuating means provided at said outer circumferential recess portion for actuating said writing medium advancing means, said actuating means being engaged with said writing medium advancing means;

finger gripping means provided around said circumferential recess portion of said cylindrical body, said finger gripping means having an opening, said actuating means being exposed externally through said opening of said finger gripping means; and cooperating means on said barrel and finger gripping means for preventing movement of said finger gripping means relative to said barrel, said cooperating means comprising projections provided at said recess portion of said cylindrical body, and grooves formed in said finger gripping means, said finger gripping means mounted within said recess portion with said grooves thereof receiving said projections therein.

5. The writing instrument as claimed in claim 4, wherein said finger gripping means has first and second ends, wherein said projections axially project into said recess portion of said cylindrical body from opposite walls of said recess portion, and wherein said grooves are formed in said first and second ends of said finger gripping means.

6. The writing instrument as claimed in claim 5, wherein said finger gripping means is made of an elastic material.

7. The writing instrument as claimed in claim 5, wherein said finger gripping means comprises an elastic material.

8. The writing instrument as claimed in claim 4, wherein said finger gripping means is made of an elastic material.

9. The writing instrument as claimed in claim 4, wherein said finger gripping means comprises an elastic material.

10. A writing instrument comprising:

a barrel having a cylindrical body, said cylindrical body having a finger gripping area and an outer circumferential recess portion provided around said finger gripping area;

a writing medium advancing structure axially movably disposed within said barrel;

an actuator provided at said outer circumferential recess portion for actuating said writing medium advancing structure, said actuator being engaged with said writing medium advancing structure;

a finger gripping member provided around said circumferential recess portion of said cylindrical body, said finger gripping member having an opening, said actuator being exposed externally through said opening of said finger gripping member; and a cooperator portion on said barrel and said finger gripping member for preventing movement of said finger gripping member relative to said barrel, said cooperator portion comprising projections provided at said recess portion of said cylindrical body, and grooves formed in said finger gripping member, said finger gripping member mounted within said recess portion with said grooves thereof receiving said projections therein.

11. The writing instrument as claimed in claim 10, wherein said finger gripping member has first and second ends, wherein said projections axially project into said recess portion of said cylindrical body from opposite walls of said recess portion, and wherein said grooves are formed in said first and second ends of said finger gripping member.

12. The writing instrument as claimed in claim 11, wherein said finger gripping member is made of an elastic material.

13. The writing instrument as claimed in claim 11, wherein said finger gripping member comprises an elastic material.

14. The writing instrument as claimed in claim 10, wherein said finger gripping member is made of an elastic material.

15. The writing instrument as claimed in claim 10, wherein said finger gripping member comprises an elastic material.

* * * * *